US006069448A

United States Patent [19]

Yeh

[11] Patent Number: 6,069,448

[45] Date of Patent: May 30, 2000

[54] LCD BACKLIGHT CONVERTER HAVING A TEMPERATURE COMPENSATING MEANS FOR REGULATING BRIGHTNESS

[75] Inventor: Henry Yeh, Chung-Li, Taiwan

[73] Assignee: Twinhead International Corp., Kaohsiung, Taiwan

[21] Appl. No.: 09/286,382

[22] Filed: Apr. 5, 1999

Related U.S. Application Data

[63] Continuation-in-part of application No. 08/951,770, Oct. 16, 1997, abandoned.

[51] Int. Cl.[7] ..... H05B 37/02

[52] U.S. Cl. ..... 315/149; 315/157; 315/158; 315/307

[58] Field of Search ..... 315/149, 156, 315/157, 158, 159, 307, 224

[56] References Cited

U.S. PATENT DOCUMENTS 4,682,084 7/1987 Kuhnel et al. ..... 315/307

*Primary Examiner*—David H. Vu

[57] ABSTRACT

A LCD backlight converter includes a temperature detection circuit arranged between a cold cathode fluorescent lamp and a backlight feedback control circuit. The temperature detection circuit has a sensor connected in series between a pulse width modulator and the cold cathode fluorescent lamp for detecting the environmental temperature. A DC/DC power adapter provides power to the pulse width modulator for driving the cold cathode fluorescent lamp. The output of the temperature detection circuit is sent to the backlight feedback control circuit that generates controls signals for controlling the output frequency of the pulse width modulator as well as the output voltage of a DC/DC power adapter. Appropriate driving voltage and current are provided to the cold cathode fluorescent lamp by the pulse width modulator according to the environmental temperature so that the lamp is normally turned on and maintains normal brightness.

3 Claims, 1 Drawing Sheet

Figure 1:
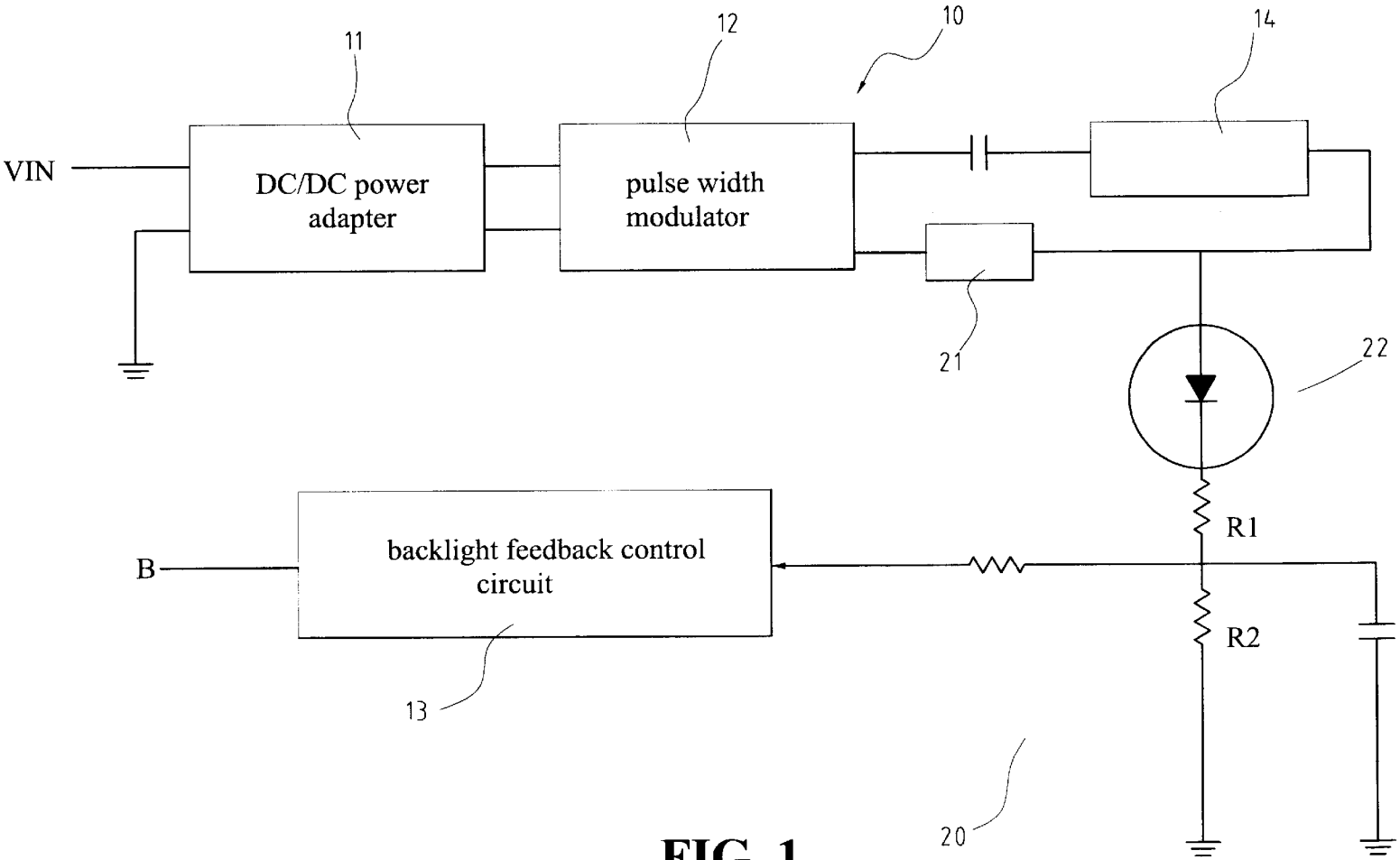

LCD BACKLIGHT CONVERTER HAVING A TEMPERATURE COMPENSATING MEANS FOR REGULATING BRIGHTNESS

This is a continuation-in-part of Ser. No. 08/951,770, filed Oct. 16, 1997.

FIELD OF THE INVENTION

This invention relates to a temperature compensating device for an LCD backlight converter, particularly to a circuit in which suitable voltage and current are provided according to the variation of environmental temperature so that at different environmental temperature, the cold cathode fluorescent lamp (CCFL) may be normally turned on and operated to maintain its normal brightness.

BACKGROUND OF THE INVENTION

For a notebook computer, a LCD (Liquid Crystal Display) is usually used as a display device. Because the LCD itself does not have a light source, a cold cathode fluorescent lamp is used to emit light under the control of a backlight converter. The backlight converter comprises a DC/DC power adapter, a pulse width modulator (PWM) and a backlight feedback control circuit. The cold cathode fluorescent lamp is mounted at the output of the pulse width modulator. The backlight feedback control circuit receives a brightness regulation signal from the notebook computer system, and controls the magnitude of the output voltage of the DC/DC power adapter and the frequency of the pulse width modulator.

In the backlight converter, the input voltage VIN is converted from the voltage level in DC/DC power adapter into a high voltage. A high frequency signal is generated by means of the oscillation in the pulse width modulator to form a high voltage having the high frequency for actuating gas within the cold cathode fluorescent lamp to emit light. Because the activity of the gas in the cold cathode fluorescent lamp varies according to the environmental temperature, and because the sale places of the notebook manufacturers probably include Europe, America, Canada, Japan, etc., it is possible that at low temperature the backlight converter can not provide sufficient high voltage and current to allow the cold cathode fluorescent lamp to retain normal brightness. At the worst condition the lamp may not be turned on.

SUMMARY OF THE INVENTION

It is an object of the present invention to provide a temperature compensating device for a LCD backlight converter in which a temperature detection circuit is arranged between the cold cathode fluorescent lamp (CCFL) and the backlight feedback control circuit. In the temperature detection circuit, a sensor which is useful for detecting the environmental temperature, is connected in series between the pulse width modulator and the cold cathode fluorescent lamp. Suitable driving voltage and current which vary according to the environmental temperature, are provided so that at different environmental temperature, the cold cathode fluorescent lamp may be normally turned on and operated to maintain its normal brightness. The problem of failing to retain the normal brightness due to variation of the environmental temperature is thus solved.

BRIEF DESCRIPTIONS OF THE DRAWINGS

FIG. 1 is the circuit diagram of the temperature compensating device of the present invention.

DETAILED DESCRIPTIONS OF THE INVENTION

As shown in FIG. 1, the backlight converter 10 comprises a DC/DC power adapter 11, a pulse width modulator 12 and a backlight feedback control circuit 13. The backlight feedback control circuit 13 receives a brightness regulation signal B from the notebook computer system, and controls the multiple of the frequency of the pulse width modulator 12 as well as the output voltage of the DC/DC power adapter 11. In the backlight converter 10, the DC/DC power adapter 11 converts the input voltage VIN into a high voltage, and the high voltage is changed into a high frequency signal by the pulse width modulator 12 to form a high voltage having a high frequency so as to drive the gas in the cold cathode fluorescent lamp 14 to emit light.

The cold cathode fluorescent lamp (CCFL) 14 is placed at the output of the pulse width modulator 12. In this invention, a temperature detection circuit 20 is disposed between the cold cathode fluorescent lamp 14 and the backlight feedback control circuit 13. The temperature detection circuit 20 comprises a sensor 21 and a voltage divider 22. The sensor 21 is connected between the cold cathode fluorescent lamp 14 and the pulse width modulator 12. The voltage divider 22 comprises a resistor R1 and a resistor R2. One terminal of the resistor R1 is coupled between the sensor 21 and the cold cathode fluorescent lamp 14 via a diode. The sensor 21 and the voltage divider 22 are connected in parallel to the cold cathode fluorescent lamp 14. The node between the resistor R1 and the resistor R2 is coupled to the backlight feedback control circuit 13.

The sensor 21 can be thermal resistors which are normally divided into two categories, positive temperature coefficient and negative temperature coefficient thermal resistors. The property of positive coefficient thermal resistor is that the higher the temperature is, the higher resistance of the thermal resistor is. The property of the negative coefficient thermal resistor is that the less the temperature is, the higher resistance of the thermal resistor is. For example, if a negative coefficient thermal resistor is used, in the environmental of low temperature the negative coefficient resistor generates a high impedance which is higher than that of the voltage divider 22. Most of the current which flows through the cold cathode fluorescent lamp 14, flows into the voltage divider 22 so as to form a divided voltage across the resistor R2. The backlight feedback control circuit 13 receives the divided voltage in order to generate two control signals that are sent to the DC/DC power adapter 11 and the pulse width modulator 12.

The magnitude of the output voltage of the DC/DC power adapter 11 and the output frequency of the pulse width modulator 12 are proportional to their respective control signals which are derived from the ratio between the resistance of R1 and R2. A higher DC/DC power adapter output voltage also increases the output voltage of the pulse width modulator 12. A higher output frequency allows the pulse width modulator 12 to provide a higher output current. In other words, both the output voltage and current of the pulse width modulator are determined by the ratio of the R1 resistance to R2 resistance.

The ratio which changes according to the variation of temperature is fed back to the DC/DC power adapter 11 and the pulse width modulator 12 so that the voltage and current provided to the cold cathode fluorescent lamp 14 increase or decrease according to the variation of temperature. Therefore, the cold cathode fluorescent lamp 14 can be normally turned on and operated. The brightness of the lamp can be retained.

What is claimed is:

1. An LCD backlight converter for regulating brightness, comprising:

a cold cathode fluorescent lamp;

a pulse width modulator coupled to said lamp for providing voltage and current to said lamp;

a DC/DC power adapter supplying power to said pulse width modulator;

a temperature compensating device coupled to said pulse width modulator and said lamp, said temperature compensating device including a temperature sensor for detecting environmental temperature variation and a voltage divider for providing a signal in response to the temperature variation; and a backlight feedback control circuit receiving the signal from said voltage divider and generating a first control signal for controlling the output voltage level of said DC/DC power adapter and a second control signal for controlling the output frequency of said pulse width modulator;

wherein both voltage and current provided to said lamp by said pulse width modulator increase or decrease according to the temperature variation.

2. The LCD backlight converter according to claim 1, wherein said temperature sensor is a positive coefficient thermal resistor.

3. The LCD backlight converter according to claim 1, wherein said temperature sensor is a negative coefficient thermal resistor.

* * * * *